United States Patent [19]

Beucher et al.

[11] Patent Number: 4,839,648

[45] Date of Patent: Jun. 13, 1989

[54] METHOD OF DETERMINING THE TRAJECTORY OF A BODY SUITABLE FOR MOVING ALONG A PORTION OF A PATH, AND APPARATUS FOR IMPLEMENTING THE METHOD

[75] Inventors: Serge Beucher, Ury; Jean-Marc Blosseville, Clamart; Francois Lenoir, La Varenne, all of France

[73] Assignees: Association Pour La Recherche et le Developpement Des Methodes et Processus Industriels (Armines); Institut National De Recherche Sur Les Transports et Leur Securite (I.N.R.E.T.S.), France

[21] Appl. No.: 143,875

[22] Filed: Jan. 14, 1988

[30] Foreign Application Priority Data

Jan. 14, 1987 [FR] France ..... 87 00316

[51] Int. Cl.[4] ..... G08G 1/01

[52] U.S. Cl. ..... 340/933; 340/937; 358/105

[58] Field of Search ..... 340/933, 937, 942, 934, 340/936, 939; 358/93, 103, 105, 108

[56] References Cited

U.S. PATENT DOCUMENTS

| | | | |
|---|---|---|---|
| 3,685,012 | 8/1972 | Case et al. | 340/937 |
| 4,214,265 | 7/1980 | Olesen | 340/937 X |
| 4,249,207 | 2/1981 | Harman et al. | 358/108 |
| 4,258,351 | 3/1981 | Shigeta et al. . | |
| 4,433,325 | 2/1984 | Tanaka et al. | 340/937 |
| 4,661,853 | 4/1987 | Roeder et al. | 358/105 X |

FOREIGN PATENT DOCUMENTS

| | | | |
|---|---|---|---|
| 2204841 | 5/1974 | France . | |
| 0123900 | 9/1979 | Japan | 340/942 |
| 0010112 | 1/1985 | Japan | 340/937 |

*Primary Examiner*—Joseph A. Orsino
*Assistant Examiner*—Brian R. Tumm
*Attorney, Agent, or Firm*—Sughrue, Mion, Zinn, Macpeak, and Seas

[57] ABSTRACT

A method of determining the trajectory of a body (1) such as a vehicle body on a relatively plane path portion (2), the method being characterized in that it consists: in forming a main real image (4) of the path portion in a plane (19) at a non-zero angle (5) with the path portion; in decomposing said main image as formed into a plurality of points (21); in determining the relationship between the size of a unit length (30) taken substantially at the level of the path portion and the size of its image formed in the main image the size being a function of the number of points covered by the image and of the location of the unit length on said path portion; in determining a secondary image (32) in the main image, the secondary image corresponding to a longitudinal reference mark (31) related to the vehicle on the path portion; and in determining the various successive positions (32, 33, 34) of the secondary image by correlation of the number of points covered by the secondary image, given that the secondary image corresponds, according to the relationship, to a length which is constant on the path portion.

13 Claims, 4 Drawing Sheets

METHOD OF DETERMINING THE TRAJECTORY OF A BODY SUITABLE FOR MOVING ALONG A PORTION OF A PATH, AND APPARATUS FOR IMPLEMENTING THE METHOD

The present invention relates to methods of determining the trajectory of a body suitable for moving on a portion of a path, and more particularly to methods making it possible to determine the trajectory of motor type vehicles on paths such as roads, motorways, etc. . . . , over a relatively long distance and on displacement surfaces of various shapes such as a rectilinear portion, two portions constituting a crossroads, etc. The present invention also relates to apparatus for implementing said methods.

BACKGROUND OF THE INVENTION

Motor vehicle traffic has continued to increase for numerous years and this increase has not always been followed, in some regions, by a suitable improvement in the road network. This means that in some circumstances, jams occur which undoubtedly hinder traffic flow. It has therefore been thought that it should be possible to remedy these drawbacks by monitoring vehicle traffic.

In order to perform this type of monitoring, it is necessary to provide sensors capable of giving an image of vehicle traffic. Numerous sensors have been developed. For example, a sensor has been devised based on light rays which are directed towards the paths along which the vehicles run. Light sensitive receivers are associated with these light rays as generally returned by reflecting surfaces disposed for this purpose on the roadway, with the receivers delivering traffic-representative signals at their outputs each time a vehicle interrupts these light beams.

This technique gives good results. However, the signals delivered are representative of traffic at one point only and the sensors used are not flexible in operation since they require items to be placed on the roadway. They must therefore be located in defined positions and they cannot be moved without giving rise to difficulties. Further, the elements disposed on the roadway need frequent attention, if only to clean their reflecting surfaces.

Other sensors have been made for increasing the area under surveillance. This applies to a sensor constituted by a magnetic loop embedded in the roadway. Such a sensor mitigates the above-mentioned drawbacks to some extent, but its use still remains too localized and it is always related to a given position on the roadway.

Thus, the present invention seeks to implement a method of determining the trajectory of a body such as a motor vehicle, for example, on a portion of a path, thereby making it possible to monitor a larger area of the path without requiring special additions to the portion of the path under surveillance, and which is capable of giving a plurality of results defining all the parameters of given traffic, e.g. motor vehicle traffic.

The present invention also seeks to provide apparatus for implementing a method.

SUMMARY OF THE INVENTION

More precisely, the present invention provides a method determining the trajectory of a body such as a vehicle body on a relatively plane path portion, the method consisting in:

forming a main real image of said path portion in a plane at a non-zero angle with said path portion;

decomposing said main image as formed into a plurality of points;

determining the relationship between the size of a unit length taken substantially at the level of said path portion and the size of its image formed in said main image, said size being a function of the number of points covered by said image and of the location of said unit length on said path portion;

determining a secondary image in said main image, said secondary image corresponding to a longitudinal reference mark related to said vehicle on said path portion; and determining the various successive positions of said secondary image by correlation of the number of points covered by said secondary image, given that said secondary image corresponds, according to said relationship, to a length which is constant on said path portion.

The present invention also provides apparatus for implementing said method.

BRIEF DESCRIPTION OF THE DRAWINGS

An implementation of the invention is described by way of example with reference to the accompanying drawings, in which.

MORE DETAILED DESCRIPTION

It is initially specified that the set of figures show the same set of items for explaining one particular implementation of the method in accordance with the invention. As a result, the same references are used therein to designate the same items, regardless of the figure in which any particular item appears.

Figure 1:
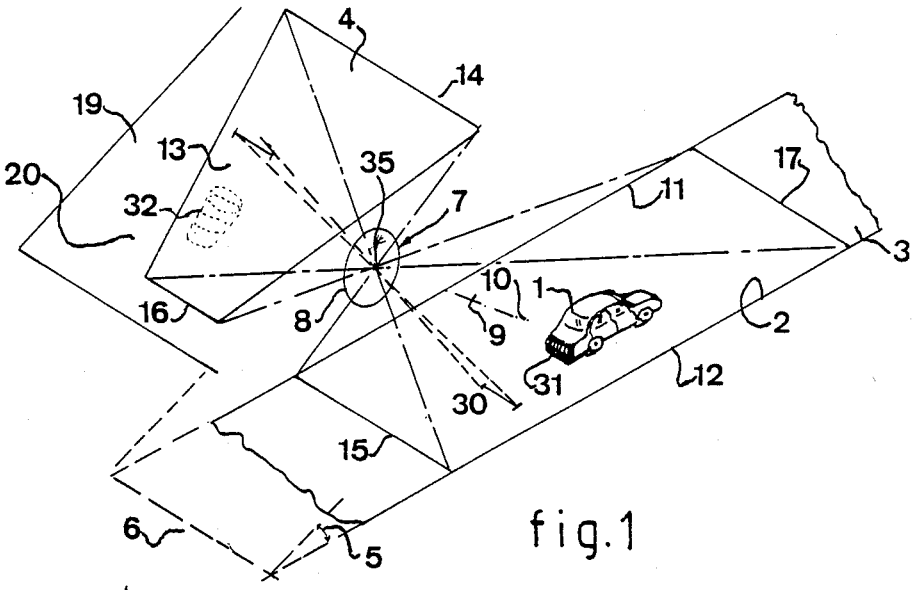
FIGS. 1 to 6 are diagrams for explaining the implementation of the method in accordance with the invention.

The method makes it possible to determine the trajectory of a body such as a motor vehicle 1 on a portion 2 of a path 3 (see FIG. 1). Preferably, this path portion is chosen in such a manner that its surface is substantially plane, regardless of its slope.

An image 4 of this path portion is formed in a second plane 19 which is at a non-zero angle 5 with the path portion, such that the line of intersection 6 between these two planes lies outside the path portion. This image is advantageously produced by focusing means 7, for example such as a converging lens 8 disposed so that its optical axis 9 passes substantially through the center 10 of the path portion 2.

Figure 2:
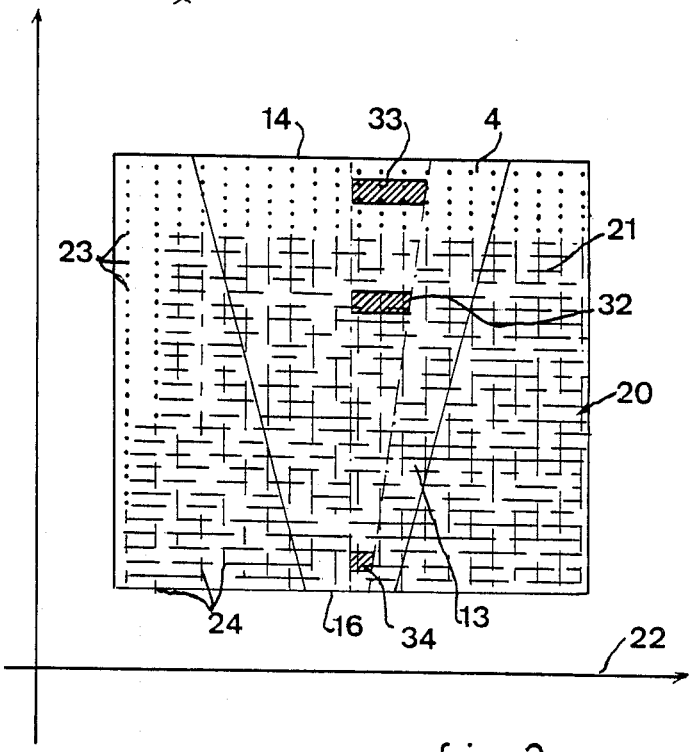
Figure 3:
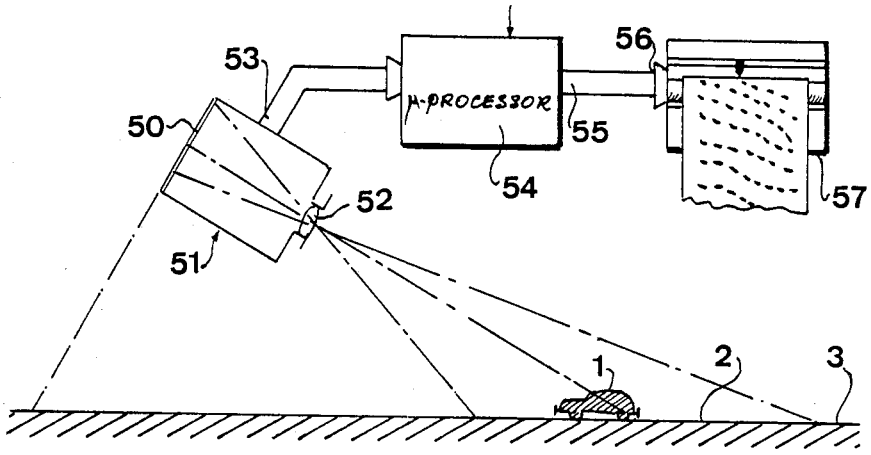

Since the edges 11 and 12 of the path portion are generally substantially parallel, and since the surface of this path portion has been chosen to be plane, the image 4 constitutes a trapezium 13 whose larger base 14 corresponds to the limit line 15 delimiting the end of the path portion which is nearer to the line of intersection 6 between the two planes, while its small base 16 corresponds to the other limit line 17 constituting the other transverse limit of the path portion 2. These two limit lines are arbitrarily defined by the field of the lens 8 and also by the photosensitive surface 20 which receives the image (as explained below, with reference to FIG. 2).

The image 4 is received on a photosensitive surface 20 comprising a plurality of photosensitive points 21, each of which can be individually addressed in a frame of reference 22.

Advantageously, in particular for facilitating the means that implement the method, the reference frame 22 is an orthogonal reference frame and the photosensitive points are distributed uniformly in lines 23 and in columns 24, for example such as in a hexagonal raster, in order to constitute a well-defined matrix. The number of points 21 per unit area of the photosensitive receiving surface 20 should be as large as possible.

The method then consists in determining the size of a unit length 30 on the path portion 2 and in measuring the size of its image on the receiving surface at numerous points thereon. In general, a relationship is established between the size of a unit length taken substantially on the path portion and the size of its image formed in the main image as a function of the number of points overlapped in said image and of the location of said unit length on the path portion between the two limit lines 15 and 17.

This relationship thus makes it possible to establish a one-to-one correspondence between a secondary longitudinal image in the main image 4 and a real length situated substantially on the path portion.

As a practical example, suppose that the length of the bumper 31 of a vehicle 1 is defined. If the vehicle runs along the path portion 2 between the two limits 15 and 17 going away from limit 15 towards limit 17, it is clear that the real length of the bumper remains unchanged. However, its image 32 formed on the receiving surface will vary by a length which corresponds to a larger number of points 33 situated close to the larger base 14 of the trapezium, and to a smaller number of points 34 situated on the small base 16. This correspondence is based on a relationship given by a formula relating the value of the angle 5 written "a", the distance "h" between the optical center 35 of the lens 8 and the plane of the path portion 2, a length "L" taken on the path portion 2 (e.g. the length 30 shown in FIG. 1), the length "x" of the corresponding image measured as a number of points in the image plane 4, the distance "f" of the image plane 4 from the optical center 35 (i.e. substantially the focal length of the lens 8), and the distance "d" representing the position of the length "L" on the path relative to a point of origin which is the projection of the optical center 35 on the plane of the path 3. This relationship has the form:

$$d=h.\tan(a)+L.x/(A-B.x)\cos(a) \text{ in which}$$

$$A=L.f.\cos(a)/h \text{ and}$$

$$B=L.\sin(a)/h$$

Under these conditions, consider a reference mark on a vehicle and its image in the main image 4. The trajectory of the vehicle on the path portion can be determined by tracking changes in the image of the reference mark. The change in this image of the reference mark is essentially constituted by a change in a length which corresponds to a length which is constant on the path, said variations being defined by the relationship given above, thereby giving the parameters of the trajectory of the vehicles corresponding to the reference mark whose image is analysed.

As mentioned above, it is therefore necessary to know the values of the length of a secondary image in the main image. To facilitate implementing the method, the photosensitive definition points 21 in the image are given by the target 50 in a video camera 51 whose objective lens 52 is equivalent to the above-defined focusing lens 8. The target 50 is constituted by photosensitive points which are referred to by the person skilled in the art as "pixels" which are capable of being read easily and very quickly by the line-by-line video scanning technique, with each pixel having a well-defined address in the orthogonal frame of reference 22.

Thus, for each point of pixel, it is very easy to obtain electronic data representative of its state of illumination and of its address. To do this, a member 54 for acquiring and processing data and for generating result signals is connected to the output 53 of the video camera. The member 54 has its output 55 connected to the input 56 of a system for displaying the result signals 57, e.g. such as a paper recorder or a remanence screen, etc. The member 54 may be a processor specialized in such processing, for example.

Figure 4:
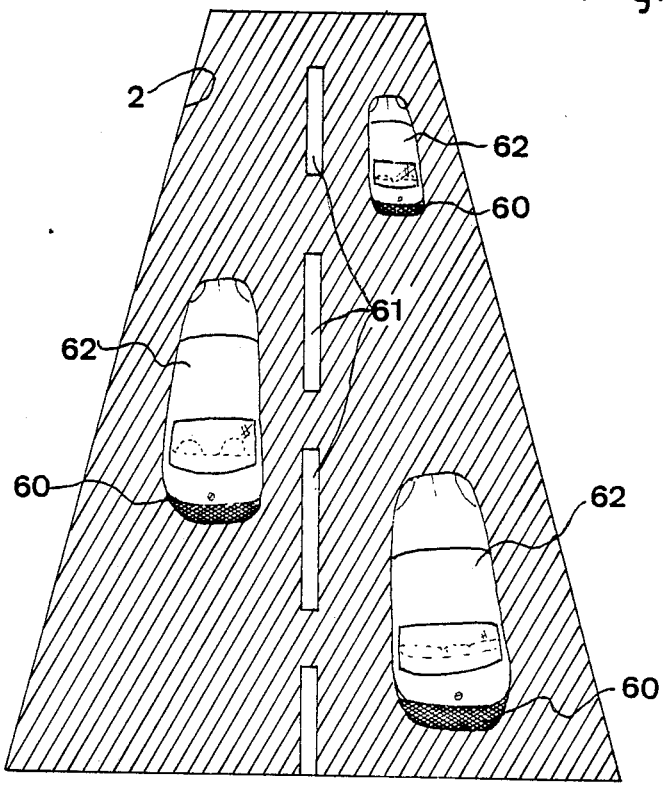

As mentioned above, it is necessary to be able to attribute a characteristic reference mark related to each vehicle passing along the path portion 2, said reference mark being of constant length and being clearly distinguishable from the overall view of the path. FIG. 4 shows, by way of example, vehicles moving along the path portion which is naturally illuminated by sunlight, or which is artificially illuminated. It can be observed, that in general, the path portion 2 is generally gray in color and that two types of contrast value appear when a vehicle moves along the path regardless of the type of illumination, although the contrast is more marked under natural illumination.

These two contrasting images are the shadow 60 of a car projected onto the path and/or the car itself. While a car is running along the entire length of the path portion 2, it may be assumed that the position of the sun and the orientation of the sun's rays do not change, since the distance travelled by the vehicle is a few tens of meters, or at most a few hundreds of meters. Further, apart from very rare exceptions, the length of a shadow is very well defined. Regardless of whether the shadows come from cars or from trucks, they are between 1.5 meters and 2.5 meters long.

In contrast, the metal roofs 62 of the vehicles, although they are painted, still have a much higher reflection coefficient than does the path portion, (with the possible exception of continuous or discontinuous lines 61 painted on the roadway in order to delimit traffic lanes). However, since these lines are narrow, they can be discriminated on the basis of their width, as can small size objects situated on vehicles and producing parasitic reflections, e.g. rearview mirrors.

It is thus very easy to identify vehicles by considering the shadow 60 that they cast or by considering the brighter light that they reflect, or by a combination of both phenomena.

Figure 5:
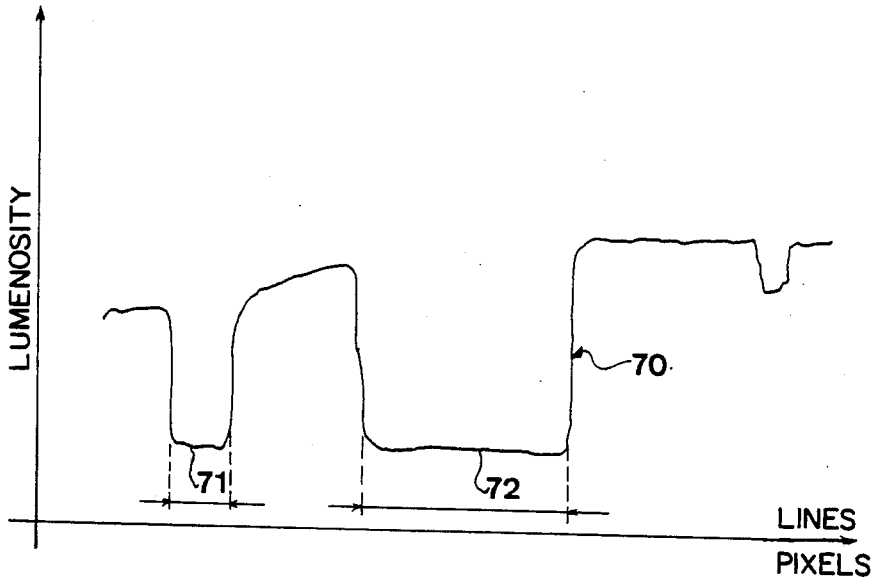

FIG. 5 is a graph showing a curve 70 representative of the quantity of light on a line 23 of pixels in the target 50 of the video camera 51. For example, there are two portions 71 and 72 of reduced light intensity which correspond to zones of shadow on the path portion 2 whose image is formed on the target. The above-defined relationship makes it possible to establish the real length of an object on the path portion which corresponds to an image in the main image. Thus, those portions 71 and 72 whose dimensions do not correspond to the transverse dimension of a motor vehicle, as mentioned above, can be eliminated. In the example shown, the portion 71 should be rejected since it corresponds to an object whose size does not lie within a predetermined range.

However, if the portion 72 is of a length which corresponds to an object lying in the predetermined range, it is highly probable that it represents the shadow of a vehicle.

Naturally, since the shadows of vehicles extend over a certain height, a plurality of successive curves 70 must be taken into consideration. If the portion 72 is to be found in nearly all of these curves, it is then almost certain that a vehicle has been identified on the path portion 2.

This portion 72 thus corresponds to a reference related to a vehicle and the trajectory of the vehicle along the path portion 2 can be determined by analyzing changes in said portion 72 as it moves along the main image 4.

The processor member 54 generally includes a clock so that the position of the vehicle on the path portion can be dated.

Figure 6:
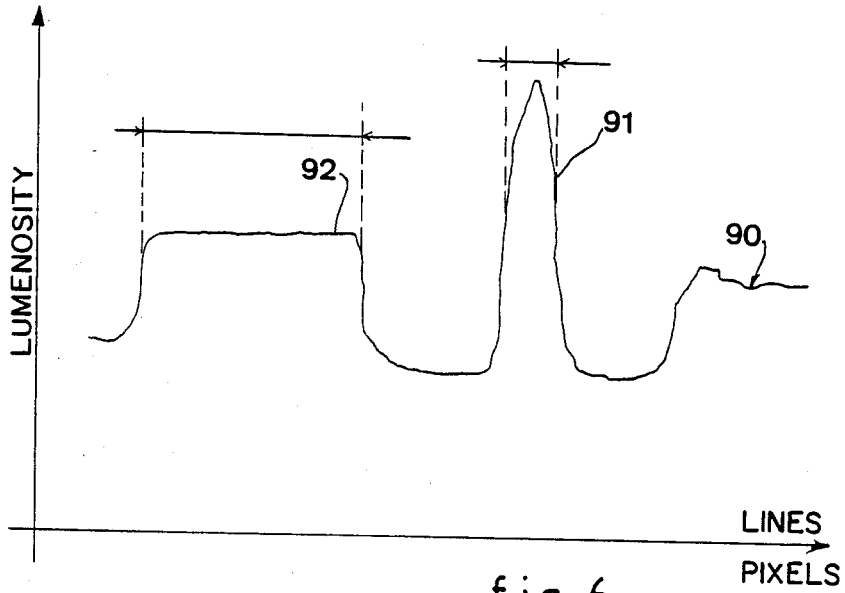

The above description relates to analyzing and recognizing a vehicle as a function of a dark reference mark. However, a reference mark based on pale zones may also be used. FIG. 6 shows a curve 90 showing the quantity of light along a line 23 of pixels in the photosensitive target of the video camera. By way of example, this curve has two portions 91 and 92 corresponding to objects which are pale in color and which lie on the path portion 2. These two portions could be used to discriminate between objects whose dimensions lie within a certain range in the same manner as described with reference to FIG. 5. A pale portion, such as the portion 92, could be used for determining the trajectory of a vehicle in the manner described above providing its length is equivalent to the transverse dimension of a vehicle.

Naturally, the method could be implemented by using vehicle marking based both on zones which are darker than the roadway and zones which are paler than the roadway, in order to obtain greater certainty concerning the presence of a vehicle on the path portion.

The various images related to vehicles may be analysed continuously or sequentially, with sequential analysis allowing the electronic circuits to generate signals representative of the results between each sequence, thereby making it possible to provide a processor member 54 of structure which is less complex than that which would be required for continuous analysis.

Figure 7:
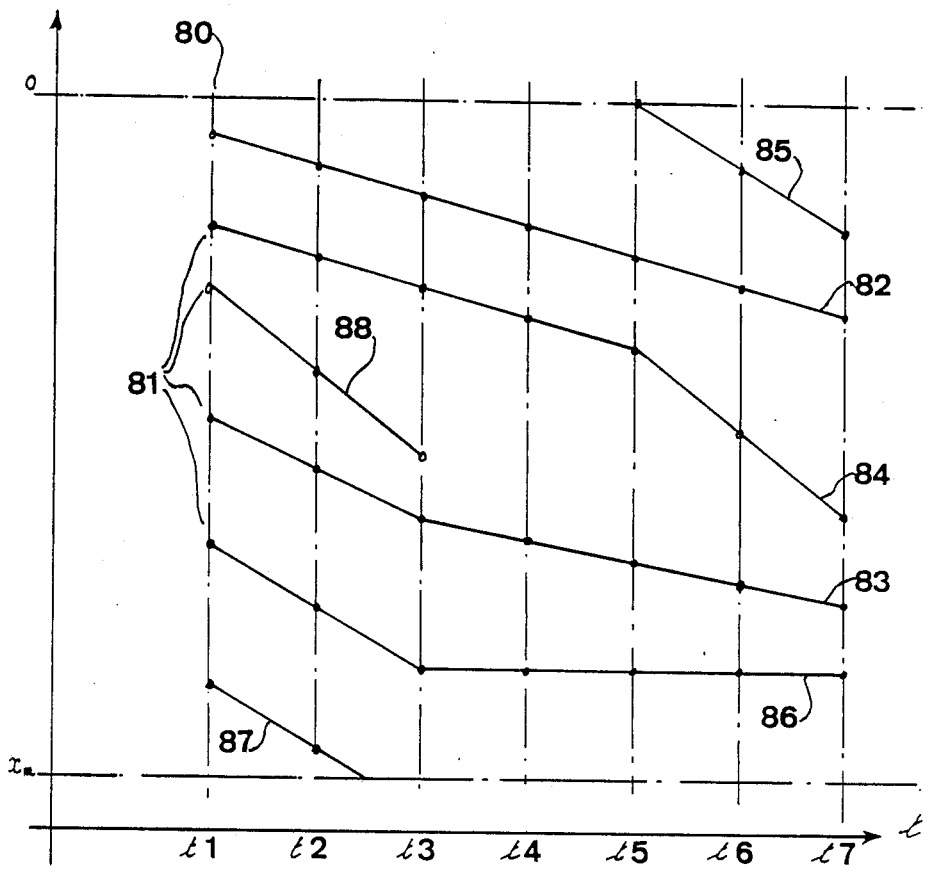
FIG. 7 shows an example of a result obtained by implementing the method in accordance with the invention.

By way of illustration, FIG. 7 shows graphical results of sequential analysis on a path portion between an origin O and an end Xm, for seven successive sequences t1 to t7. These results could be displayed on paper running continuously through a graphic recorder 57. The positions of vehicles on the path portion are given along the Y axis of this diagram and the sequence dates are given along the X axis. Thus, at instant t1, the path portion included six vehicles 80. This diagram can be used to determine the various trajectories 81 of the vehicles on the path portion:

trajectory 82 corresponds to a vehicle travelling at constant speed between instants t1 and t7, as shown by the slope of this trajectory being constant;

trajectory 85 relates to a vehicle which moves onto the path portion at instant t5;

trajectory 84 relates to a vehicle which was travelling at constant speed between instants t1 and t5, and which then accelerated after instant t5, as indicated by the increase in slope of this trajectory;

trajectory 88 relates to a vehicle which was on the path portion up to instant t3 and which then left it at this instant in order to overtake the vehicle in front which corresponds, for example, to trajectory 83 which shows that the vehicle in front slowed down at instant t3; if two path portions corresponding to two traffic lanes as shown in FIG. 4 are monitored simultaneously in the same manner, then trajectory 88 would appear at instant t3 on the diagram corresponding to the other path portion in continuity with the trajectory shown in FIG. 7;

trajectory 86 relates to a vehicle which was stationary on the path between instants t3 and t7 as can be seen by its constant position on the Y axis; and trajectory 87 relates to a vehicle which left the path portion between instants t2 and t3.

From the above description, it can be seen that it is possible to monitor the traffic on a large path portion continuously and to determine a large number of parameters including, in particular, traffic density, the instantaneous and the average speeds of vehicles, the positions of vehicles, and their changes in direction, without it being necessary to install special items in the roadway. The apparatus for implementing the method is essentially constituted by a video type camera, for example a black and white camera, positioned on a bridge or a pole, with the processing electronics taking up relatively little room and being relatively simple to implement for the person skilled in the computer art.

Further, with a method as described above, it is possible to analyze traffic simultaneously on a plurality of path portions, for example path portions having non-zero mutual angles therebetween, as between motorways and motorway slip roads, or even between portions which cross one another as, for example, at a crossroads.

We claim:

1. A method of determining the trajectory of a vehicle body on a relatively plane path portion, the method consisting of:

forming a main real image of said path portion in a plane at a non-zero angle with said path portion;

decomposing said main image as formed into a plurality of points;

determining the relationship between the size of a unit length taken substantially at the level of said path portion and the size of its image formed in said main image, said size being a function of the number of points covered by said image and the location of said unit length on said path portion;

determining a secondary image in said main image, said secondary image corresponding to a longitudinal reference mark related to a dimension of said vehicle of constant length on said path portion; and determining the various successive positions of said secondary image by correlation of the number of points covered by said secondary image, given that said secondary image corresponds, according to said relationship, to said length which is constant on said path portion.

2. A method according to claim 1, wherein the images are formed by focusing using a converging lens optical system.

3. A method according to claim 1, wherein said plurality of points are photosensitive points.

4. A method according to claim 3, wherein said plurality of points are distributed in the raster of a matrix defined relative to a frame of reference.

5. A method according to claim 1, wherein the various successive positions of said secondary image are determined by correlation of the number of points covered by said secondary image being performed by continuous analysis.

6. A method according to claim 1, wherein said secondary image is determined from at least one reference mark related to the vehicle, said reference mark being optically contrasted relative to said path.

7. A method according to claim 6, wherein said reference mark is a dark reference mark.

8. A method according to claim 7, wherein said dark reference mark is a portion of the shadow cast by said vehicle.

9. A method according to claim 6, wherein said reference mark is a pale reference mark.

10. A method according to claim 9, wherein said pale reference mark is given by light reflected from a portion of the bodywork of said vehicle.

11. A method according to claim 6, wherein said reference mark is constituted both by a dark reference mark and by a pale reference mark.

12. A method according to claim 1, wherein the various successive positions of said secondary image are determined by correlation of the number of points covered by said secondary image, said correlation being performed by comparing the number of said points with a range of point numbers determined as a function of the position of said secondary image in said main image.

13. Apparatus for implementing the method according to claim 1, said apparatus comprising a video camera whose target is defined by a plurality of pixels, a processor for processing the signals delivered at the output from said camera, and a recorder whose input is connected to the output of said processor.

* * * * *